US012127605B2

(12) United States Patent
Hadeed

(10) Patent No.: US 12,127,605 B2
(45) Date of Patent: Oct. 29, 2024

(54) SOCK HAVING RAISED FEATURES, A MOLD ASSEMBLY AND A METHOD OF MANUFACTURE

(71) Applicant: Justin Hadeed, Coconut Creek, FL (US)

(72) Inventor: Justin Hadeed, Coconut Creek, FL (US)

( * ) Notice: Subject to any disclaimer, the term of this patent is extended or adjusted under 35 U.S.C. 154(b) by 578 days.

(21) Appl. No.: 17/153,099

(22) Filed: Jan. 20, 2021

(65) Prior Publication Data

US 2021/0251304 A1 Aug. 19, 2021

Related U.S. Application Data

(60) Provisional application No. 62/977,460, filed on Feb. 17, 2020.

(51) Int. Cl.
*A41B 11/00* (2006.01)

(52) U.S. Cl.
CPC ..... *A41B 11/001* (2013.01); *A41B 11/008* (2013.01)

(58) Field of Classification Search
CPC ..... A41B 11/00; A41B 11/126; A41B 11/007
See application file for complete search history.

(56) References Cited

U.S. PATENT DOCUMENTS 4,021,860 A 5/1977 Swallow et al.
4,206,515 A * 6/1980 Robinson ..... A41B 11/02 2/241
5,592,689 A * 1/1997 Matthews ..... A41D 13/0562 2/24
5,708,985 A * 1/1998 Ogden ..... D04B 1/04 66/178 R
5,737,776 A * 4/1998 Jennings ..... A41B 11/14 2/409
D394,229 S * 5/1998 Curry ..... D11/126
5,791,163 A * 8/1998 Throneburg ..... D04B 1/02 66/178 R
6,275,997 B1 * 8/2001 Richardson ..... A41B 11/005 2/239
6,708,342 B2 3/2004 Boersema
7,383,591 B1 * 6/2008 Getzwiller ..... A63B 71/14 36/114
8,220,077 B1 * 7/2012 Ott ..... A41B 11/008 2/409
9,038,201 B2 * 5/2015 Lee ..... A61H 7/007 2/239
9,675,119 B2 * 6/2017 Alston ..... A41B 11/007
2003/0000003 A1 * 1/2003 Boersema ..... A41B 13/00 2/69
2004/0009302 A1 1/2004 Patterson
2005/0107728 A1 * 5/2005 Vetters ..... A41B 11/02 602/23

(Continued)

*Primary Examiner* — Jillian K Pierorazio
(74) *Attorney, Agent, or Firm* — John Rizvi; John Rizvi, P.A.—The Patent Professor ®

(57) ABSTRACT

A sock having raised features includes one or more three-dimensional paw pads affixed thereon. More in particular, a plurality of individual three-dimensional paw pads are affixed to a bottom portion of the sock to provide a visual effect of having animal paws, and to further provide a wearer a tactile sensation of having animal paws on the wearer's foot while walking. A mold assembly and a method for the manufacture of a plurality of three-dimensional paw pads to be affixed to a sock includes at least one mold.

5 Claims, 10 Drawing Sheets

(56) References Cited

U.S. PATENT DOCUMENTS

2005/0144703 A1* 7/2005 Hilbert ..... A41B 11/008 2/239
2006/0112591 A1 6/2006 Lombardo
2006/0179549 A1* 8/2006 Huggins ..... A43B 5/12 2/239
2006/0196078 A1* 9/2006 Terlizzi ..... A43B 7/144 36/8.3
2007/0271819 A1 11/2007 Chen
2008/0110045 A1* 5/2008 Terlizzi ..... A43B 7/144 36/8.3
2009/0158504 A1 6/2009 Sparrow et al.
2010/0125933 A1* 5/2010 Barnett ..... A41B 11/02 2/409
2010/0154251 A1* 6/2010 Nataadiningrat ..... A43B 5/12 36/71
2011/0061142 A1 3/2011 Hoppins et al.
2011/0113530 A1* 5/2011 Ballard ..... A41B 11/004 2/239
2011/0277218 A1* 11/2011 Padilla ..... D04B 1/02 2/239
2013/0283637 A1* 10/2013 Wilkenfeld ..... A43B 7/26 36/8.3
2013/0333096 A1* 12/2013 Song ..... A41B 11/007 2/239
2014/0033567 A1* 2/2014 Heathcote ..... A43B 5/12 36/92
2014/0338090 A1* 11/2014 Perkins ..... A41B 11/008 2/22
2014/0352170 A1* 12/2014 Heathcote ..... A43B 5/12 36/8.3
2015/0007457 A1* 1/2015 Orza ..... A43B 7/149 36/102
2018/0332899 A1* 11/2018 Stern ..... A41B 11/007
2019/0239572 A1* 8/2019 Abbey ..... A41B 11/007
2020/0205483 A1* 7/2020 Burns ..... A41B 11/02
2020/0329782 A1* 10/2020 Kim ..... A41B 11/007

* cited by examiner

SOCK HAVING RAISED FEATURES, A MOLD ASSEMBLY AND A METHOD OF MANUFACTURE

CROSS-REFERENCE TO RELATED APPLICATIONS

This application claims the benefit of U.S. Provisional Patent Application Ser. No. 62/977,460, filed on Feb. 17, 2020, which is incorporated by reference herein in its entirety.

FIELD OF THE INVENTION

The present invention relates generally to an article of clothing, and more particularly, to a sock having raised features, a mold assembly, and a method of manufacture thereof with a mold assembly.

BACKGROUND OF THE INVENTION

Socks having decorative features are very popular clothing items and are available in various forms and sizes for adults and children. For example, casual socks with imprints of flowers, cartoon characters and animals depicted thereon are widely available in the retail marketplace and come in various colors, sizes and materials.

Other decorative socks available are not only available for casual use but also for use in industrial or commercial environments. For example, slip-resistant stockings for use by ambulatory hospital patients are used to facilitate safer walking on smooth surfaces that such patients are typically faced with in traversing a hospital setting. In some illustrative slip-resistant stocking manufacturing procedures, the slip-resistant material can be deposited in liquid form at spaced locations around the stocking. The liquid material becomes embedded in the knitted portion of the stockings and solidifies whereby the slip-resistance is a function of the solidified material having a coefficient of friction that is greater than the foot portion of the stocking.

Ideally, it would be beneficial to provide a casual sock having raised features thereon that provides visual and tactile feedback to the wearer.

Accordingly, there is need for a solution of an improved technique for manufacturing socks that have raised features that provide visual effects and direct tactile sensations to the wearer.

SUMMARY OF THE INVENTION

The present invention is generally directed to a sock having raised features. In at least one embodiment, the raised features comprise a plurality of three-dimensional paw pads thereon, and in a further embodiment, a mold assembly and a method for the manufacture thereof.

In a first implementation of the invention, a sock is provided comprising a plurality of three-dimensional paw pads that are raised from and affixed to a sock bottom surface to provide the wearer with a visual effect of having actual paws on the wearer's foot and a tactile sensation when walking as associated with actual animal paw pads. Each paw pad has a three-dimensional shape defined by a height, length and width and a certain elasticity. Given the elasticity of the plurality of three-dimensional paw pads and their raised features, a wearer of the sock may also discern certain audible feedback as the pads compress and decompress during walking when wearing the sock.

In a second aspect, a mold assembly for forming individual three-dimensional paw pads that may be affixed to a sock bottom surface of a sock to provide a wearer with the visual effect of having paws on the wearer's foot and a tactile sensation of having paws when walking. Each paw pad having a length, height, width and elasticity. The mold assembly may comprise: a base; a mold for accepting a material for forming a plurality of three-dimensional paw pads, the mold having individual paw pad impressions thereon for retaining the material from which the three-dimensional paw pads are formed; a pressure backing member having a first plurality of pressure relief vents formed thereon whereby each individual pressure relief vent is capable of being aligned with a respective one individual paw pad impression in the mold; a paw pad backing member having a second plurality of pressure relief vents formed thereon whereby each individual pressure relief vent in the paw pad backing member is capable of being aligned with a respective one individual pressure relief vent in the pressure backing portion. The paw pad backing member may be disposed between the pressure backing member and the mold; at least two alignment members and at least two fasteners may be used for assembling the individual portions of the mold assembly together with the base and applying pressure thereto for forming the paw pads from the mold material; and a plurality of clamps may be provided for applying additional pressure in combination with the alignment members and fasteners for forming the paw pads from the material.

In a third aspect, a method is provided for using a mold assembly in forming the individual three-dimensional paw pads that may be affixed to a sock bottom surface of a sock to provide a wearer with a visual attribute of having actual paws on the wearer's foot and a tactile sensation when walking.

In another aspect, a plurality of three-dimensional paw pads may be formed using a urethane foam material.

In another aspect, a plurality of three-dimensional paw pads may be formed using a polyurethane foam material.

In another aspect, a plurality of three-dimensional paw pads may be affixed to a sock bottom surface of a sock.

In another aspect, a mold of a mold assembly may be fabricated from silicone.

In another aspect, a pressure backing member may be at least partially formed from plexiglass, acrylic or more particularly, polymethyl methacrylate.

In another aspect, a paw pad backing member may comprise a canvas material.

In another aspect, a paw pad backing member may comprise a vinyl material.

These and other objects, features, and advantages of the present invention will become more readily apparent from the attached drawings and the detailed description of the preferred embodiments, which follow.

BRIEF DESCRIPTION OF THE DRAWINGS

The various embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, in one embodiment, the present invention is directed toward a sock having a plurality of three-dimensional paw pads thereon, and in one further embodiment, the present invention is directed to an apparatus and method for the manufacture thereof.

Figure 1:
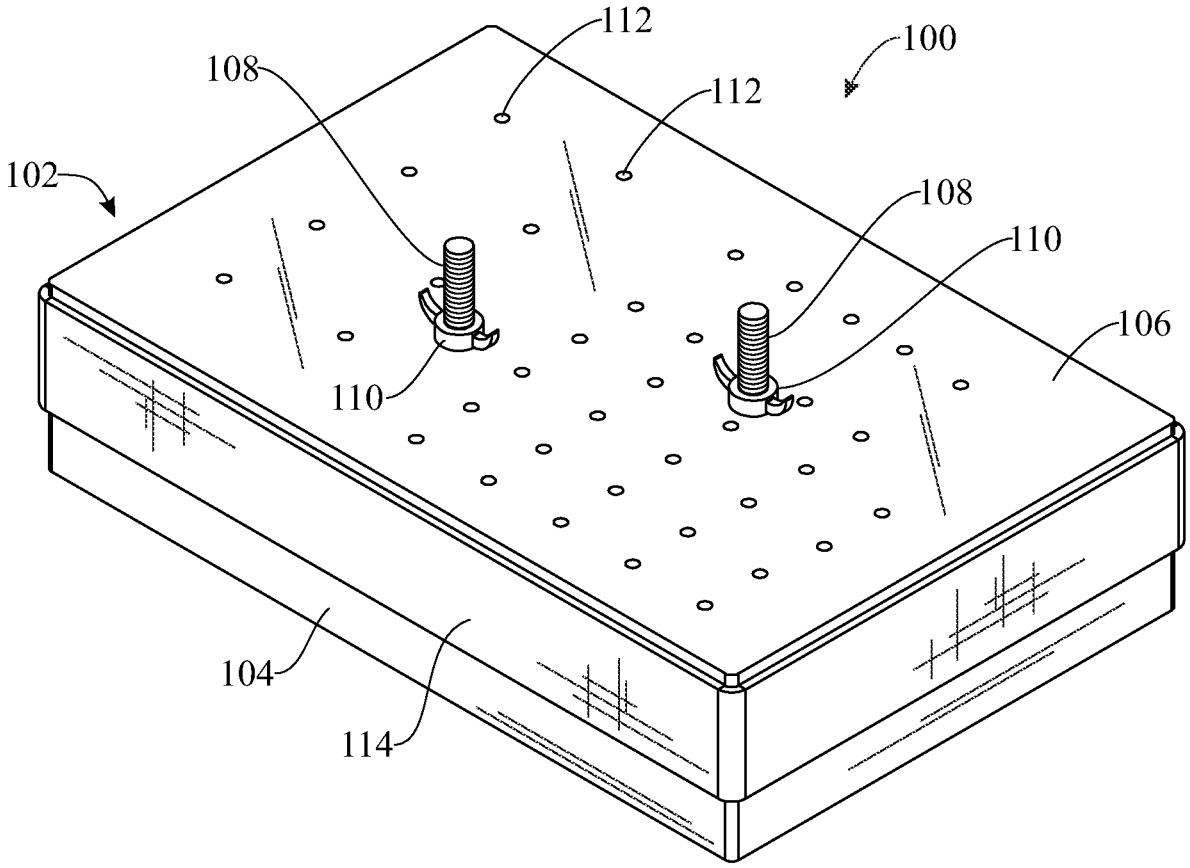
FIG. 1 presents a top isometric view of a mold assembly in accordance with a first illustrative embodiment of the present invention.
Figure 2:
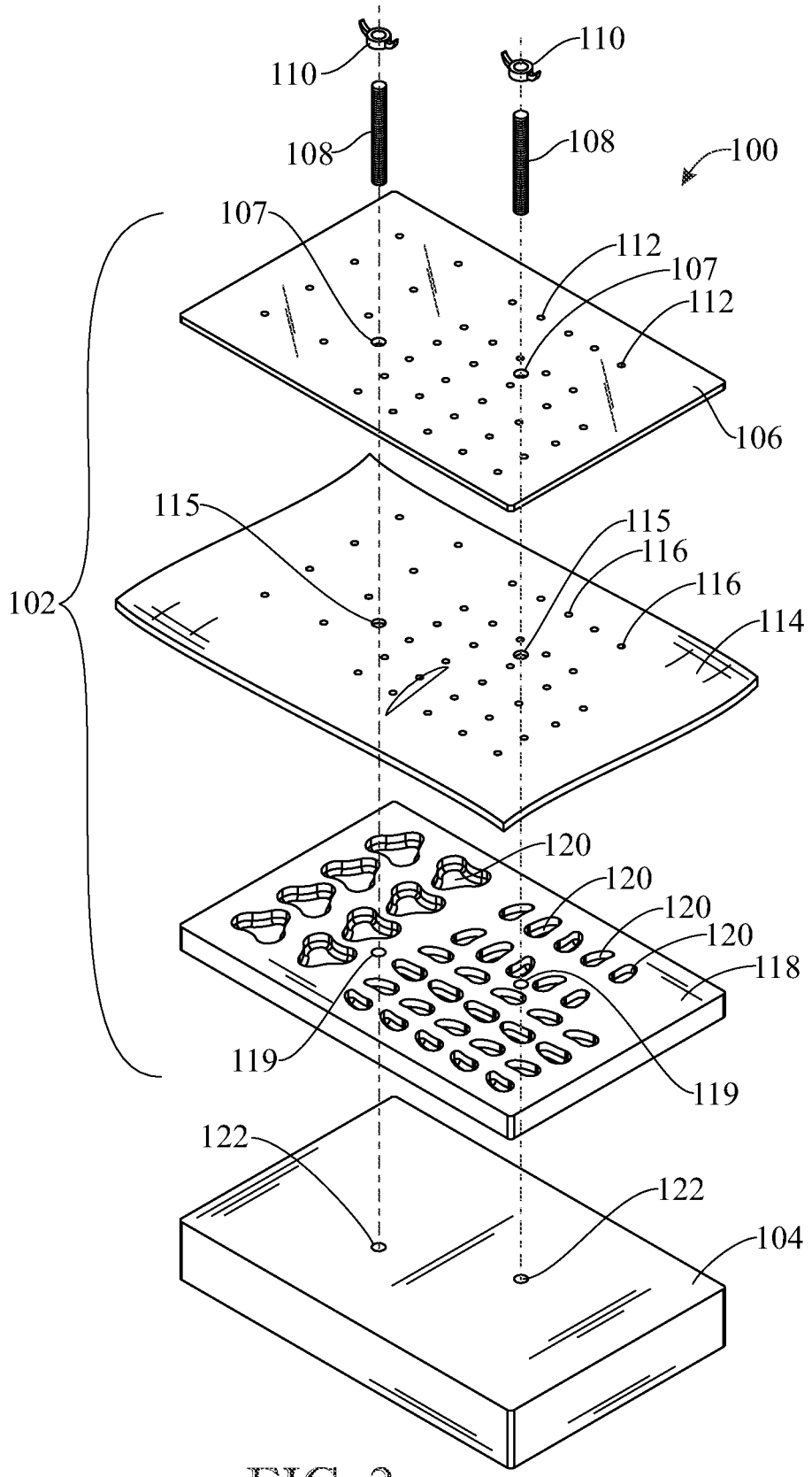
FIG. 2 presents an exploded top isometric view of the mold assembly illustrated in FIG. 1, in accordance with the present invention.

FIGS. 1-6 present several views of a mold assembly 100 in accordance with a first illustrative embodiment of the present invention. With reference initially to FIGS. 1 and 2, the mold assembly 100 includes a multi-member portion 102 and a base 104. Illustratively, the base 104 may comprise a wood material but can be any of a number of other hard and/or solid materials to provide support to mold assembly 100. As best shown in FIG. 2, the multi-member portion 102 includes a pressure backing member 106, a mold 118, and a paw pad backing member 114 sandwiched between the pressure backing member 106 and the mold 118. In some embodiments, a pressure backing member 106 may be formed from a slightly flexible plastic material including but not limited to plexiglass, acrylic or, more particularly, polymethyl methacrylate, just to name a few. A paw pad backing member 114 may also be formed from a somewhat flexible material such as, once again, by way of example only, canvas material and/or a vinyl material. As best shown in FIG. 2, the paw pad backing member 114 may have a larger footprint than the pressure backing member 106 and the mold 118 such that a portion of paw pad backing member 114 extends outside the footprint of the pressure backing member 106 for purposes that will be described in further detail herein below.

As further shown in the illustrative embodiment of FIGS. 1 and 2, a pair of alignment members 108 extends through the multi-member portion 102, and more specifically, through alignment apertures that run through the entirety of the multi-element portion 102. As shown best in FIG. 2, the pair of alignment members 108 may extend through alignment apertures 107, 115 and 119 formed in the pressure backing member 106, the paw pad backing member 114 and the mold 118, respectively. The pair of alignment members 108 may also thread into a pair of alignment apertures 122 formed in the base 104 in registration with the alignment apertures 107, 115 and 119 formed through the pressure backing member 106, the paw pad backing member 114 and the mold 118 of multi-element portion 102. In at least some embodiments, a bottom end of the alignment members 108 may be threaded, and the alignment apertures 122 formed in the base 104 may be cooperatively counter-threaded to allow the bottom ends of the alignment members 108 to thread thereinto. In some embodiments, the alignment members 108 may be threaded in their entirety, i.e., along their entire length. The alignment apertures 107, 115, 119 and/or 122 may be pre-drilled, scored, punctured or otherwise formed into the respective members of multi-member portion 102 and base 104 prior to assembly.

As shown in FIG. 1, when inserted through the multi-member portion 102, the alignment members 108 extend upwardly and perpendicular from the pressure backing member 106, such that a threaded top end of the alignment members 108 protrude outwardly and upwardly from the pressure backing member 106. In one embodiment, a fastener 110 is threaded onto each of the alignment members 108 to affix the multi-member portion 102 to the base 104, thereby completing the formation of the mold assembly 100. It will be understood that the configuration shown in FIGS. 1 and 2 with the pair of alignment members 108 and the pair of fasteners 110 is solely for illustrative purposes, and other configurations of post(s) and corresponding fastener(s) are possible that are consistent with the spirit and intent of the present invention as disclosed herein. As one example, and without limitation, the mold assembly 100 may include an alternative number of alignment members 108 and corresponding fasteners 110.

With continued reference to FIG. 2, the pressure backing member 106 comprises a first plurality of pressure relief vents 112 and the paw pad backing member 114 is provided with a second plurality of pressure relief vents 116. In turn, the mold 118 includes a plurality of individual mold impression recesses, cavities or elements 120 formed therein for accepting a mold material. The configuration and alignment of the first plurality of pressure relief vents 112 and the second plurality of pressure relief vents 116 corresponds to the configuration and placement of the plurality of individual mold impressions 120 formed in the mold 118. In particular, a specific one of the first plurality of pressure relief vents 112 through the pressure backing member 106 and a corresponding specific one of the second plurality of pressure relief vents 116 through the paw pad backing member 114 is aligned with a corresponding one of the plurality of mold impressions 120 formed in the mold 118, such as is best seen in the illustrative embodiment of FIG. 2. Furthermore, the first plurality of pressure relief vents 112 and second plurality of pressure relief vents 116 are formed and configured to be arranged in registration with and disposed in communication with one another during operation of the mold assembly 100. This will facilitate the release of excess mold material from the plurality of mold impressions 120 of the mold assembly 100 while the mold assembly 100 is compressed, as further detailed herein below.

Figure 3:
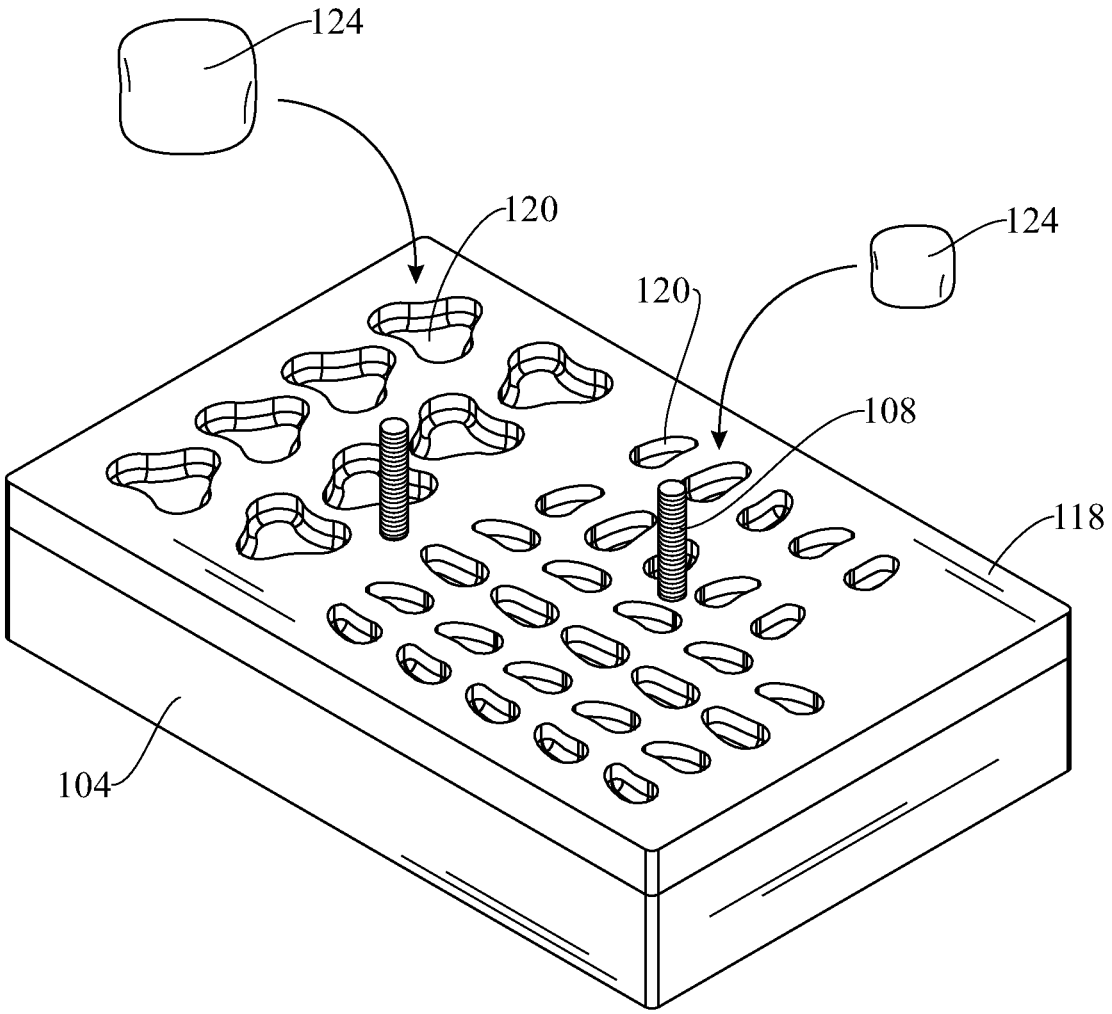
FIG. 3 presents a top isometric view of the partially-assembled mold assembly of FIG. 1, more particularly with the base, mold and alignment members in an assembled configuration, in accordance with the present invention.

The illustrative embodiments of FIGS. 3-6 show a method of use of the mold assembly 100 of FIG. 1 to manufacture a plurality of raised features, i.e., a plurality of three-dimensional paw pads, to be attached to socks, in accordance with the present invention. With reference initially to FIG. 3, the mold 118 is operatively positioned on the base 104. The pair of alignment members 108 are connected to the base 104 via alignment apertures 122 and the mold 118 is operatively positioned onto the base 118 over the extending the posts 108 through the corresponding alignment apertures 119 through the mold 118. In at least some embodiments, the alignment members 108 are threaded into the alignment apertures 122 of the base 104. Once the mold 118 has been operatively positioned on the base 104, an amount of mold material 124 is introduced, such as, poured or injected, into each of the plurality of individual mold impressions 120 formed within the mold 118 to realize the fabrication of individual three-dimensional paw pads that may be affixed to a bottom portion of a sock or other area of another fabric material to provide the wearer, for instance, with the visual effect of having paws on the wearer's foot and a tactile sensation when walking in accordance with the disclosed embodiments.

In at least one embodiment, each three-dimensional paw pad has a length, height, width as determined by the individual mold impressions 120 formed within the mold 118 and an elasticity defined by the mold material 124. In some embodiments, the mold 118 may be fabricated from silicone and the mold impressions 120 may be formed using resin casted duplicates of original clay sculptures, for example, oil-based non-drying clay, of the desired paw pads in terms of shape and size. Further, illustratively, the mold material 124 may be a urethane foam mixture that expands and facilitates the formation the three-dimensional paw pads with a desired shape and elasticity in accordance with the embodiment. In a further embodiment, the mold material 124 is a polyurethane foam mixture. In this way, when the wearer of the sock configured in accordance with the embodiments herein walks across a surface, the three-dimensional paw pads will compress and decompress providing tactile feedback to the user including an audible sound, e.g., a "squishing" feeling and sound, thereby simulating actual animal paws.

Figure 4:
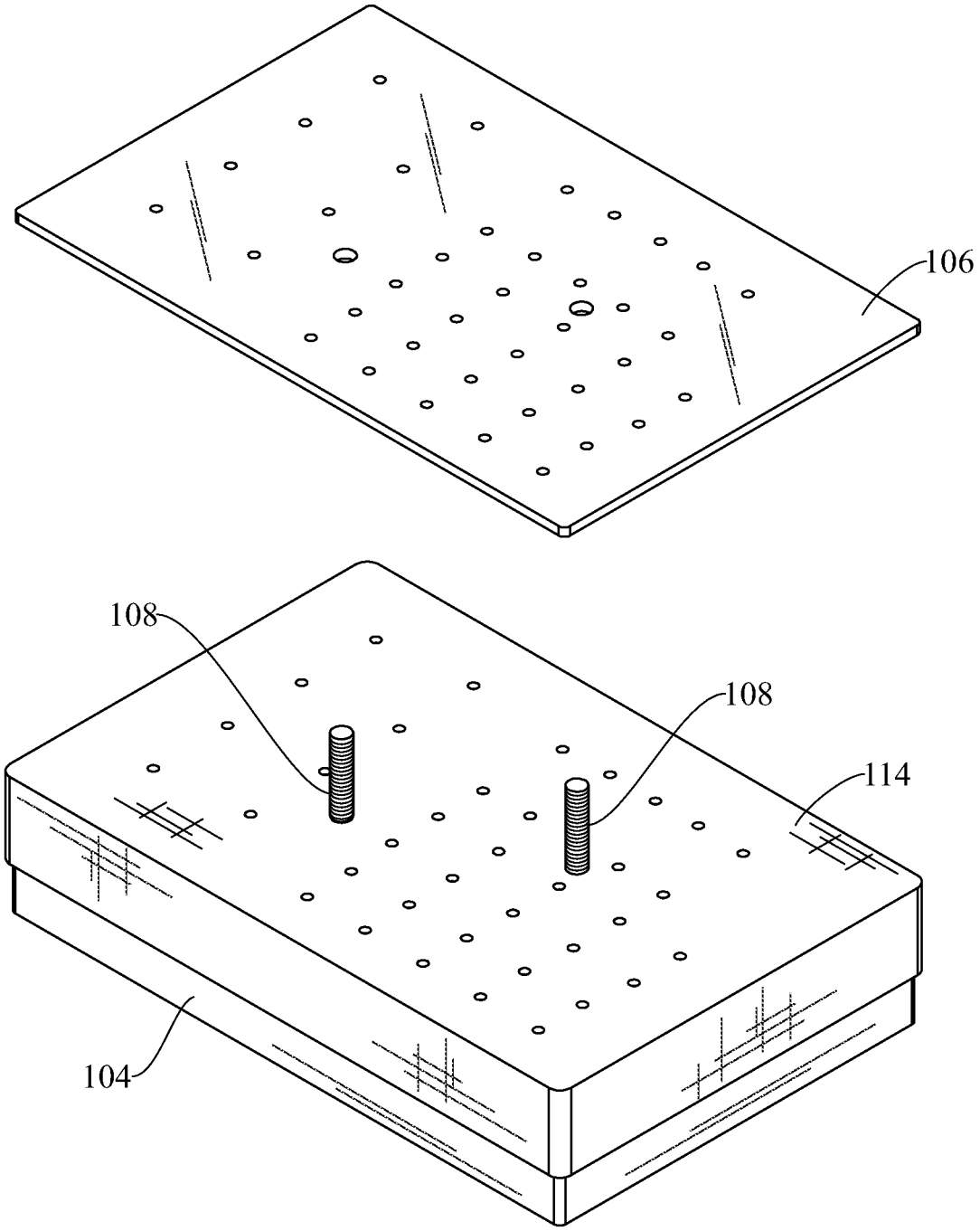
FIG. 4 presents a partially exploded, top isometric view of the mold assembly of FIG. 1, more particularly with the pressure backing member in exploded view and the partially-assembled mold assembly, in accordance with the present invention.

The illustration of FIG. 4 depicts a further stage of the method of manufacture in accordance with the present disclosure. Specifically, as shown, the paw pad backing member 114 has been positioned over the base 104 and mold 118 and aligned via the alignment members 118 which are inserted through the alignment apertures 115 in the paw pad backing member 114. In the event that the paw backing member 114 has a larger footprint as described heretofore, the paw pad backing member 114 may hang over the sides of the mold 118 and, optionally, the base 104.

Figure 5:
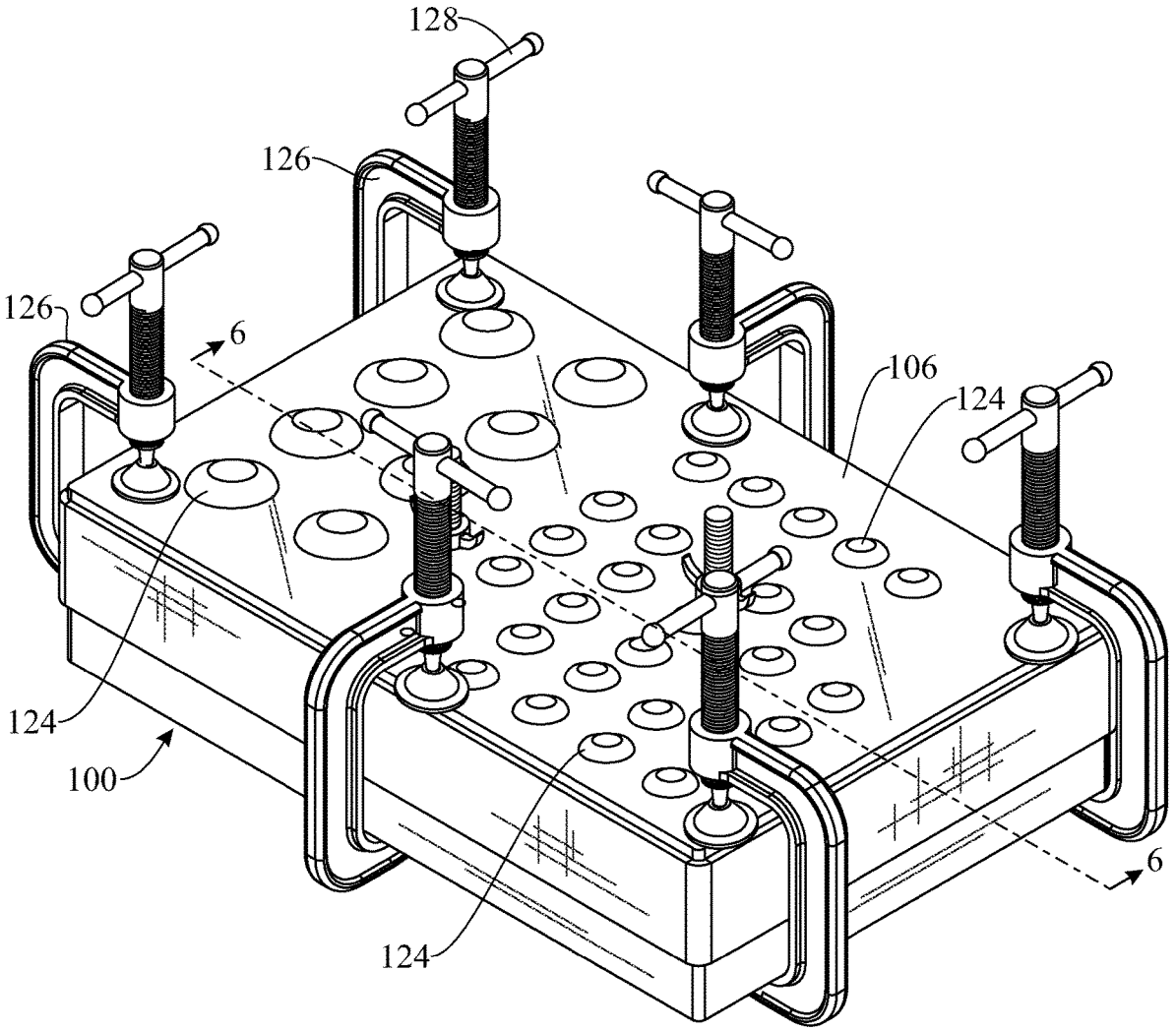
FIG. 5 presents a top isometric view of the mold assembly illustrated in FIG. 1 after injection of the mold material and application of pressure in accordance with one illustrative embodiment of a method of manufacture, in accordance with the present invention.

Next, the pressure backing member 106 is been positioned over the paw pad backing member 114 and the mold 118 in alignment via the alignment members 119 which are inserted through the alignment apertures 107 in the pressure backing member 106, such that the paw backing member 114 is sandwiched between the mold 118, having mold impressions 120 filled with amounts of mold material 124, and the pressure backing member 106, after which, pressure is applied onto the pressure backing member 106. For instance, as shown in FIG. 5, a plurality of clamps 126 may be attached externally to the mold assembly 100 and tightened to apply pressure onto the mold to force the pressure backing member 106 closer to the mold 118 and compress the mold material 124 located therebetween. Tightening of the clamps 126 may be carried out by rotating corresponding handles 128 to apply the desired pressure.

In one embodiment, the mold material 124 is an expanding urethane foam. Urethane foam is commercially available and is a commonly used two part expanding foam having good thermal insulation and expansion characteristics, such that the urethane foam will conform to the shape of a cavity or a form into which the material is poured, such as, a plurality of mold impressions 120 of mold 118. Urethane foam is also soft in terms of texture to provide comfort to the wearer of the sock manufactured in accordance with the present invention. The molded material 124 is also substantially tear proof once cured, thereby providing important wear characteristics for the sock features herein. In a further embodiment, the mold material 124 is an expanding polyurethane foam that provides similar advantages as described above with respect to the expanding urethane foam. Typically, a urethane foam product is mixed and applied at room temperature with an optimum temperature of about 24 to about 27 degrees Celsius. If the ambient temperature is too cold, the reaction is inhibited and in such cases, the urethane will shrink back after rising, losing much of its strength. Further, a two part urethane foam must be poured immediately after a quick mixing together of the component parts. The cavities or a forms to be filled, e.g., the plurality of mold impressions 120 of mold 118, must be clean and accessible, and prepared ahead of time. All surfaces should be clean of contaminants for proper bonding. As will be appreciated, urethane foam will expand, e.g., 20:1 by volume. In doing so the material can exert, for example, as much as thirty kilopascals or more of pressure in a contained area. As detailed herein, the first set of pressure relief vents 112 and the second set of pressure relief vents 116 are provided, inter alia, to permit the release of pressure buildup during fabrication of a plurality of three-dimensional paw pads in the mold impressions 120 of a mold 118.

Figure 6:
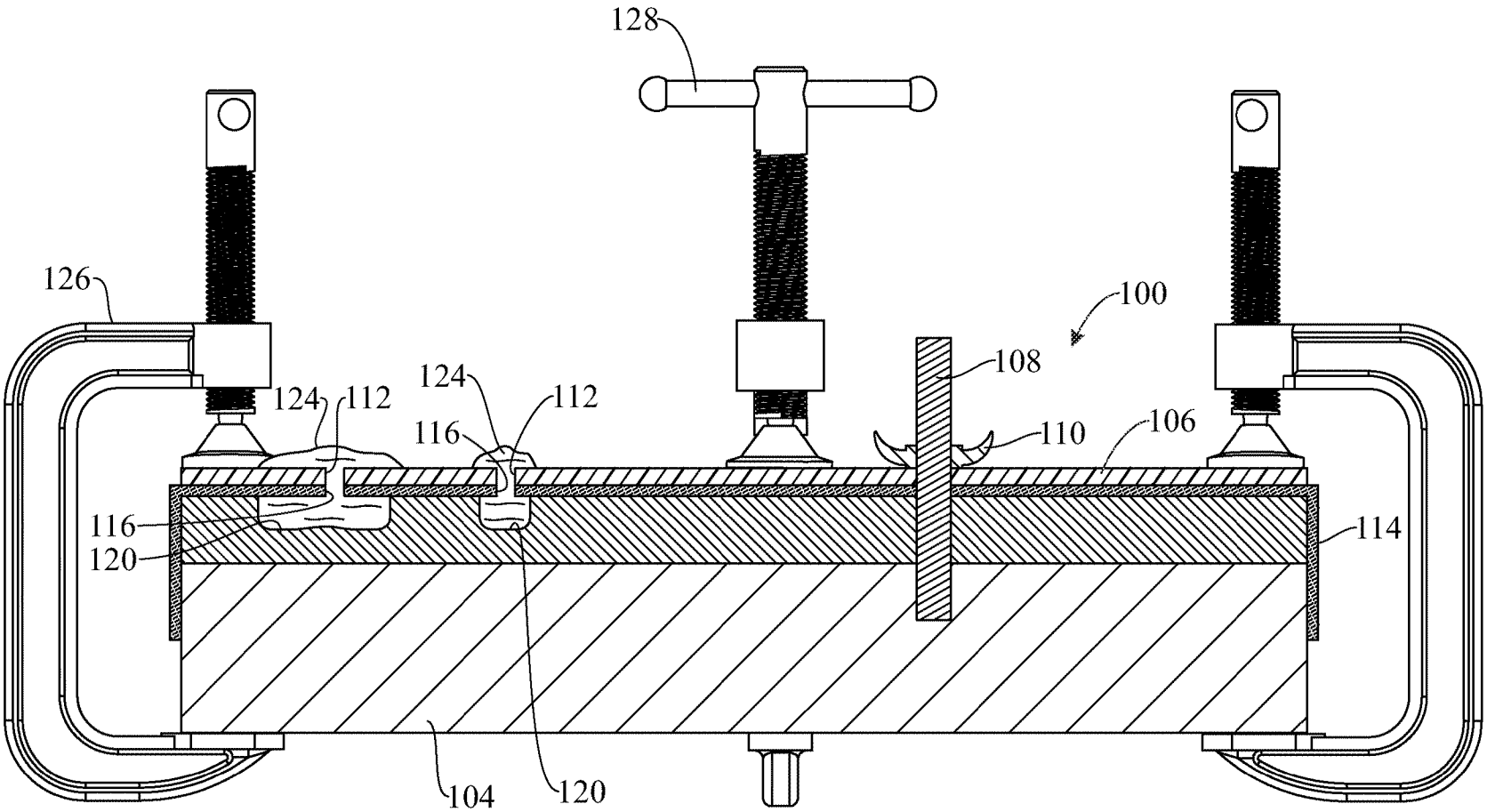
FIG. 6 presents a cross-sectional side elevation of the mold assembly illustrated in FIG. 5, in accordance with the present invention.

As shown in FIGS. 5 and 6, excess mold material 124 contained in the mold impressions 120 may flow through the aligned second and first plurality of pressure relief vents 116 and 112 formed in an aligned relation through the paw pad backing member 114 and the pressure backing member 106, respectively, and outward of the mold assembly 100. The excess mold material 124 is removed during the demolding and final forming of a plurality of three-dimensional paw pads from a corresponding plurality of mold impressions 120. The configuration of the plurality of clamps 126 shown in FIGS. 5 and 6 is one of several configurations that may be utilized as will be readily understood and appreciated.

As is well known, an animal paw is a soft foot-like part of a mammal having paw pads. The pads act as a cushion for the load-bearing limbs of the animal. A paw generally consists of a large, heart-shaped metacarpal paw pad at the paw's center, and which is generally surrounded by, in part, four load-bearing digital paw pads that are smaller in size than the metacarpal paw pad. As is well-known, animals with paws include felids such as cats and tigers, canids such as dogs and foxes, rabbits, bears and raccoons, to name just few.

Figure 7:
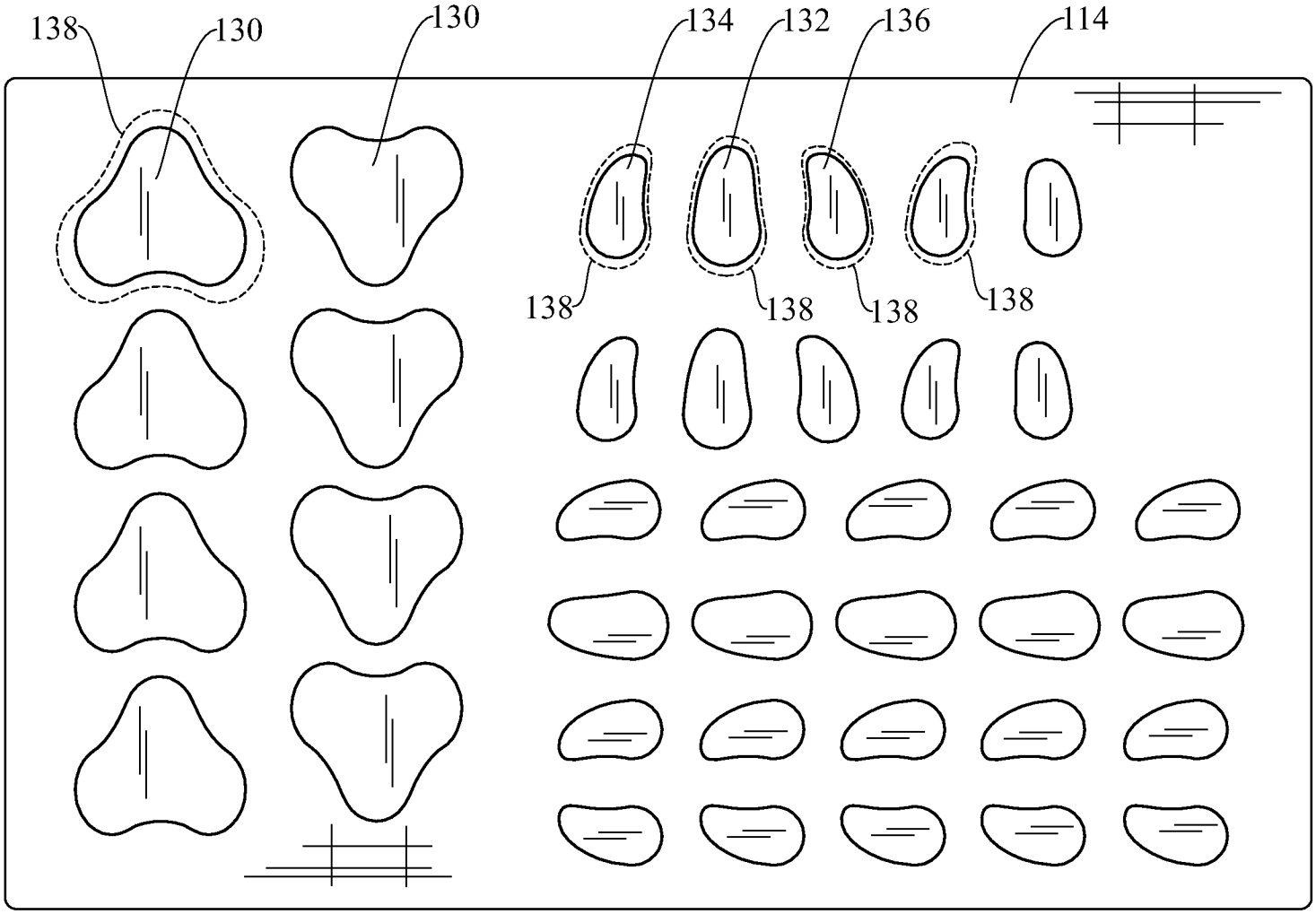
FIG. 7 presents a top plan view of a plurality of three-dimensional paw pads formed and demolded with a fabric backing using the mold assembly illustrated in FIGS. 5 and 6, in accordance with the present invention.

The illustration of FIG. 7 presents a plan view of a plurality of three-dimensional paw pads formed and demolded from mold 118, and attached to paw pad backing member 114 using the mold assembly 100 as described with reference to FIGS. 3-6. In accordance with the various embodiments herein, a metacarpal paw pad 130 may be manufactured representative of a heart-shaped metacarpal pad of an actual animal, and digital paw pads 132, 134 and 136 may be manufactured to resemble load-bearing digital pads of the actual animal. As shown, the metacarpal paw pad 130 and digital paw pads 132, 134 and 136 may be fully formed using mold assembly 100 as described in detail herein. Illustratively, certain of the paw pads shown in FIG. 7 may be removed by cutting along outlines 138 to remove the respective demolded paw pads from the collective shown. Each such removed paw pad will retain a portion of paw pad backing member 114 thereon and be used to form a specific configuration of the plurality of three-dimensional paw pads for application to a sock in accordance with at least one embodiment, as is further detailed herein below. As shown in the illustrative embodiment of FIG. 7, a total of eight (8) metacarpal paw pads 130 and thirty (30) digital paw pads 132, 134 and 136 may be formed, in accordance with the number of mold impressions 120 provided in the illustrative mold 118 shown in the drawings. In at least one embodiment, digital paw pads 132 are formed as middle, or straight, digital paw pads, digital paw pads 134 are formed in a left paw pad orientation, and digital paw pads 136 are formed in a right paw pad orientation. It must be noted, however, that alternative number and/or shapes of paw pads, or other decorative elements, may be formed without departing from the scope and intent of the present invention.

Figure 8:
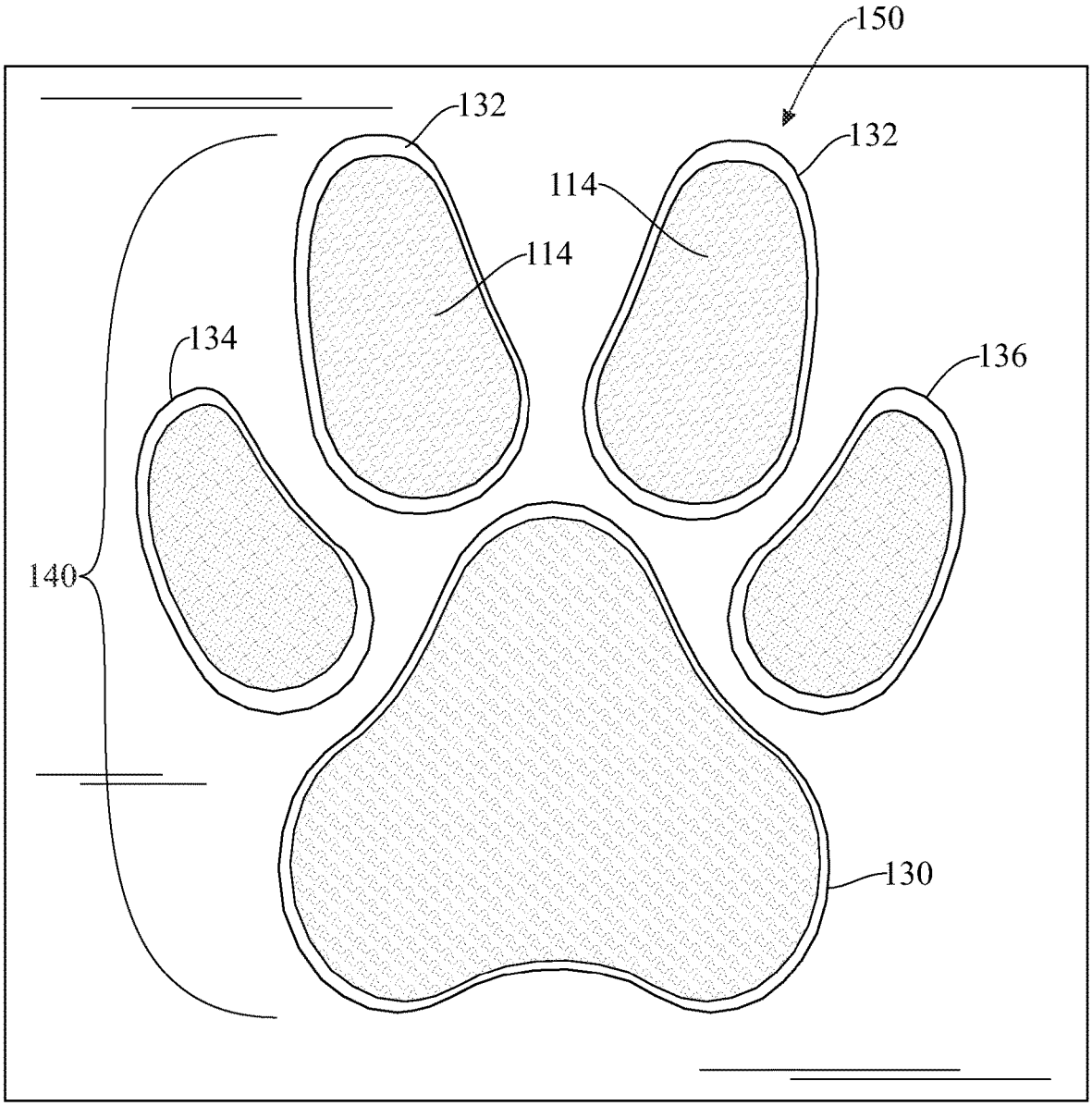
FIG. 8 presents a plan view of an illustrative embodiment of an exemplary paw comprising a plurality of three-dimensional paw pads formed in accordance with one embodiment of the present invention.

The illustrative embodiment of FIG. 8 is a plan view of an exemplary paw 150 comprising a plurality of three-dimensional paw pads 140 including one (1) metacarpal paw pad 130, two (2) digital paw pads 132, one (1) digital paw pad 134, and one (1) digital paw pad 136, wherein the plurality of three-dimensional paw pads 140 are thereby arranged so as to be representative of an actual animal paw. The view shown of the exemplary paw 150 in FIG. 8 is of the underside of each respective paw pad of the plurality of three-dimensional paw pads 140 to further highlight that, when each such paw pad is demolded from mold 118, the paw pad will retain a portion of the paw pad backing member 114 thereon. For example, as described heretofore, the paw pad backing member 114 may be a canvas, in which case the retained portion of the paw pad backing member 114 is a portion of canvas.

Figure 9:
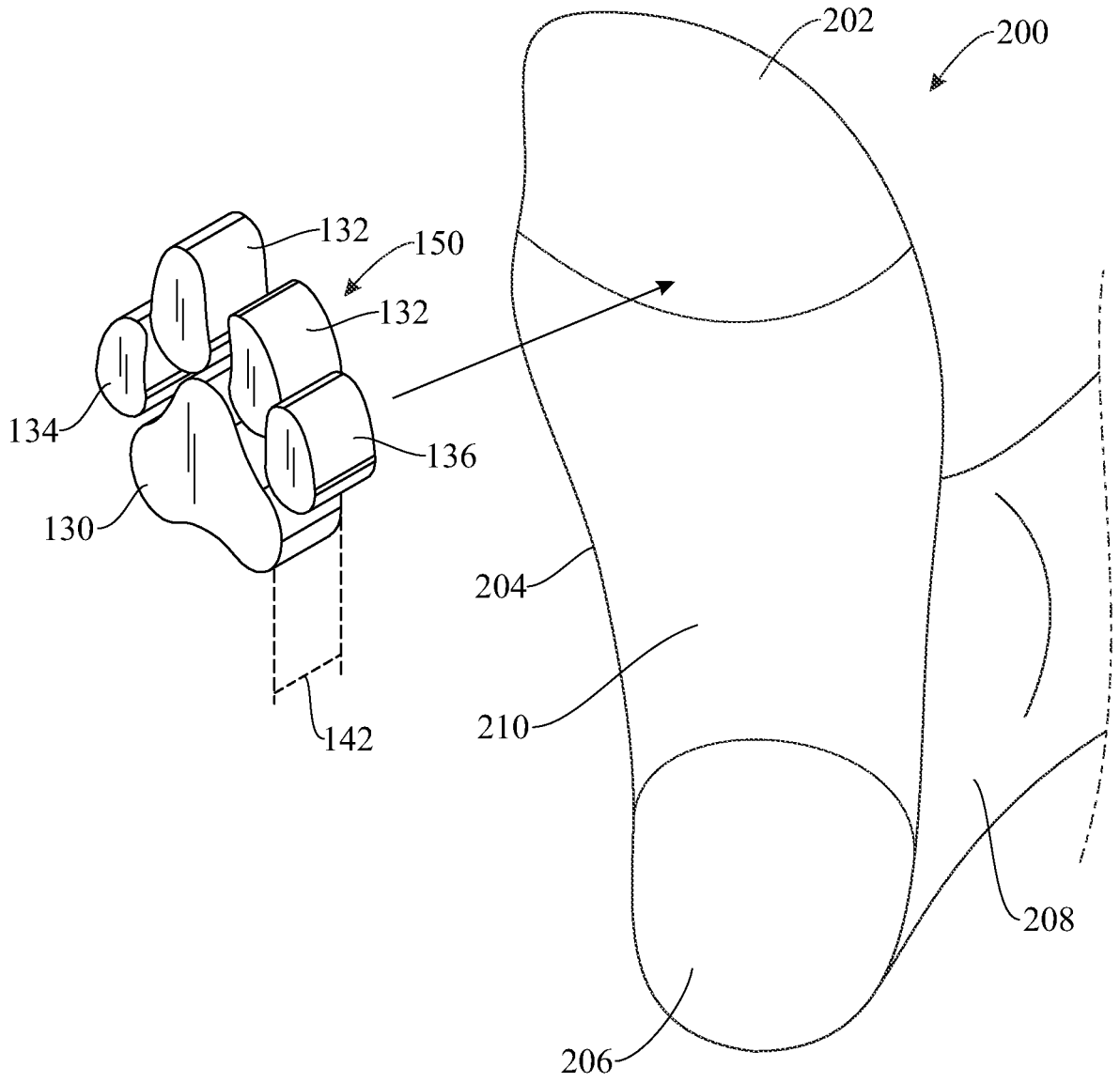
FIG. 9 presents a perspective view of the plurality of three-dimensional paw pads shown in FIG. 8 in process of being applied to a sock bottom surface in accordance with one embodiment of the present invention.

The illustrative embodiment of FIG. 9 shows a perspective view of the plurality of three-dimensional paw pads 140 of FIG. 8 in the process of being applied to a sock 200 thereby forming the paw 150 thereon. As shown, the sock 200 comprises a sock body 204 which may include a sock toe portion 202, a sock heel portion 206 and a sock leg portion 208. As will be appreciated, in at least one embodiment, a pair of socks 200 are provided, one to be worn on each foot of a wearer. The sock 200 depicted herein is a so-called "knee-high" sock; however, alternative socks may be used. The sock 200 may be made from cotton, a cotton blend or other applicable materials. It will be understood that sock 200 has a sock top surface (not shown) and an opposite sock bottom surface 210 that ultimately surround the wearer's foot when inserted therein. To simulate the sensation of animal paws, the plurality of three-dimensional paw pads 140 may be affixed on or about the sock toe portion 202 of the sock bottom surface 210 in accordance with one embodiment. More particularly, the plurality of three-dimensional paw pads 140 may be affixed to and extend outwardly from the sock toe portion 202. The plurality of three-dimensional paw pads 140 provide a visual effect and a tactile sensation to a person wearing sock 200. In accordance with an embodiment, a stencil (not shown) may be used to assist with the placement and alignment of the plurality of three-dimensional paw pads 140 as they are affixed to the sock 200. In at least one embodiment, the plurality of three-dimensional paw pads 140 may be affixed to sock toe portion 202 using an adhesive or bonding agent such as, but not limited to, Infinity PUR MP75 polyurethane hot melt adhesive, or E6000™ craft adhesive. The latter, for instance, is a commercially available bonding agent formulated to meet high performance industrial requirements, and is a non-flammable, vibration proof product that forms a permanent, waterproof bond and offers extreme flexibility in terms of application, and is also paintable.

Each paw pad of the plurality of three-dimensional paw pads 140 has a substantially similar thickness 142 resulting from the fabrication steps detailed herein above. In some embodiments, a height 142 may have a thickness of approximately 2 centimeters, e.g., 1.9 centimeters. Once adhered to a sock 200, a plurality of three-dimensional paw pads 140 are raised and extend away from the sock toe portion 202 and, therefore, from the sock body 204 of the sock 200 as well, and are alternatively compressed and decompressed when the wearer of sock 200 walks across a surface. Advantageously, in accordance with at least one embodiment, the sock 200 delivers a certain tactile feedback to the wearer, essentially a sponge-like sensation, in addition to providing a visual effect and appearance that a wearer's foot or feet have animal paw pads. Given the elasticity of the plurality of three-dimensional paw pads 140 and their raised features on a sock 200, a wearer may also discern certain audible feedback as the three-dimensional paw pads 140 compress and decompress while the wearer is walking while donning the sock or socks 200.

In summary, as detailed above, a method of fabricating a plurality of three-dimensional paw pads 140 and a sock or socks 200 having the plurality of three-dimensional paw pads 140 securely affixed thereto comprises providing a mold assembly 100 for fabricating the plurality of three-dimensional paw pads 140 from an amount of mold material 124, e.g., foaming urethane. The mold assembly 100, in at least one embodiment, comprises: a base 104; a mold 118 for accepting an amount of mold material 124 for forming a plurality of three-dimensional paw pads 140, the mold 118 having one or more individual paw pad mold impressions 120 thereon for retaining the amount of mold material 124 from which the individual three-dimensional paw pads 140 will be formed; a pressure backing member 106 having a first plurality of pressure relief vents 112 formed therethrough, wherein each individual pressure relief vent 112 is aligned with a respective one of the individual paw pad mold impressions 120; a paw pad backing member 114 having a second plurality of pressure relief vent 116 formed therethrough, wherein each individual pressure relief vent 116 is aligned with a respective one of the plurality of pressure relief vents 112 in the pressure backing member 106, the paw pad backing member 114 being disposed between the pressure backing member 106 and the mold 118; one or more alignment members 108 and corresponding fasteners 110, such as, by way of example, wing nuts such as are shown throughout the figures, to hold the individual portions of the mold assembly 100 together with the base 104 and applying pressure thereto; and, one or more clamps 126 or other pressure-exerting tool for applying pressure, which may optionally be applied in combination with the alignment members 108 and fasteners 110.

The method, in one further embodiment, comprises pouring an amount of mold material 124 into one or more paw pad mold impressions 120 of a mold 118 and applying pressure via a plurality of clamps 126, which may be in combination with alignment members 108 and corresponding fasteners 110, or other such fastener, and allowing the mold material 124 to cure. After which, a plurality of three-dimensional paw pads 140 may be removed from the mold 118 with a portion of the fabric backing of the paw pad backing member 114 intact and affixed to each of the plurality of three-dimensional paw pads 140 upon extraction from the mold assembly 100. Select ones of the plurality of three-dimensional paw pads 140, such as, by way of example, a total of five (5) three-dimensional paw pads 140, so as to represent and construct a desired paw pattern, are removed, e.g., by cutting, individually with the fabric backing of the paw pad backing member 114 intact and affixed thereto. The individual three-dimensional paw pads 140 are then adhered to a sock 200 by applying an adhesive to permanently bond each of the individual three-dimensional paw pads 140 to the sock 200.

Figure 10:
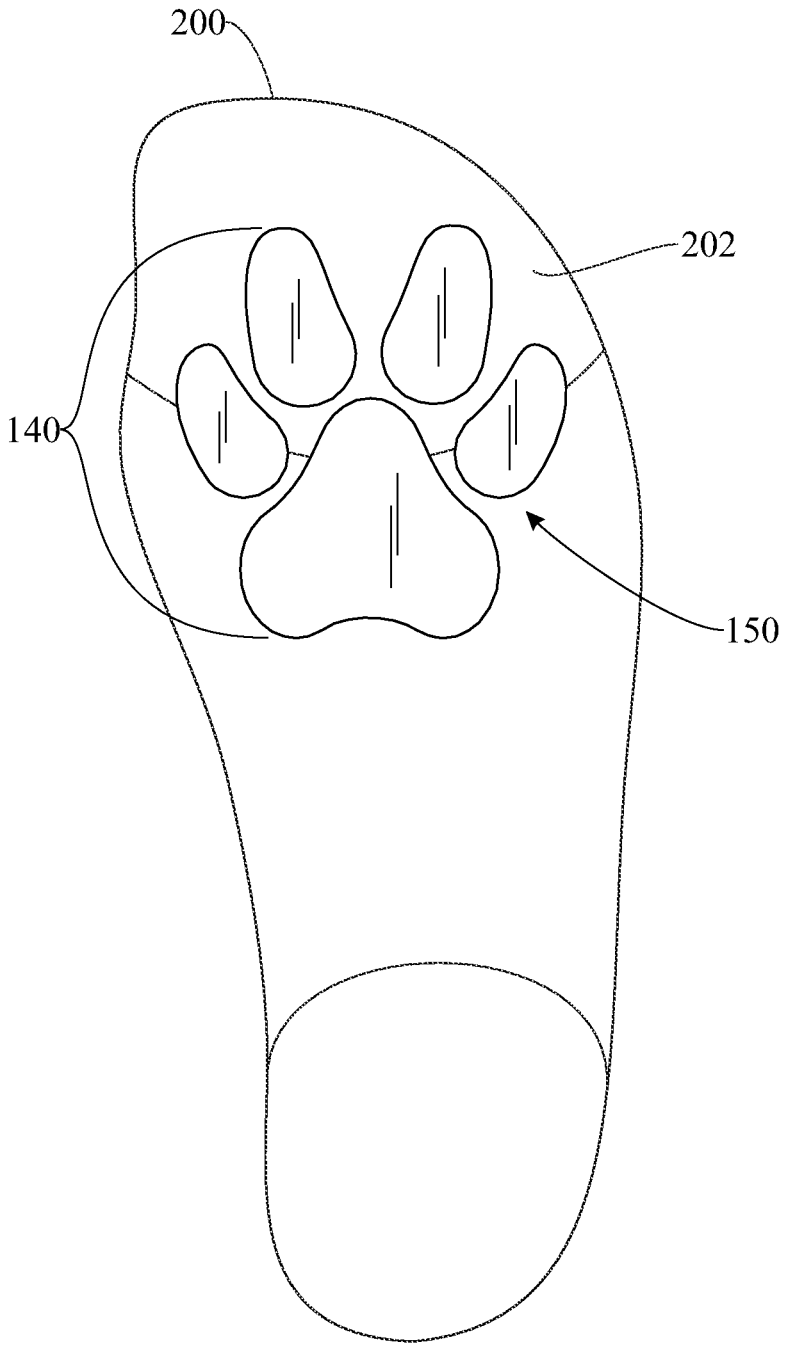
FIG. 10 presents a bottom plan view of one illustrative embodiment of an exemplary sock having a plurality of three-dimensional paw pads arranged and securely affixed to the sock bottom surface proximate a sock toe portion thereof in accordance with one embodiment of the present invention.

FIG. 10 is a bottom plan view of one illustrative embodiment of a sock 200 with a paw 150 configured in accordance with the present invention securely affixed thereto. Illustratively, once affixed to a toe portion 202 of a sock 200, the plurality of three-dimensional paw pads 140 may encompass an area approximately 8 centimeters long by approximately 8 centimeters wide, and may be approximately 2 centimeters high. As shown In FIG. 10, the plurality of three-dimensional paw pads 140 are affixed to the sock 200 such that they cover the front ball of the person's foot when wearing the sock 200. As detailed above, the plurality of three-dimensional paw pads 140 are affixed to and extend outward from the sock toe portion 202 and, further, the plurality of three-dimensional paw pads 140 provide a visual effect and a tactile sensation to a person wearing the sock 200. A sock 200 having the plurality of three-dimensional paw pads 140 securely affixed thereto in accordance with the present invention is intended primarily for casual use in a variety of indoor environments and settings including but not limited to lounging, cosplay, boudoir and photo shoots, to name just a few.

Alternative embodiments are contemplated to those depicted herein. For instance, the three-dimensional paw pads 140 may be made with different color orientations to contrast with or match the sock color to which the paw pads are affixed. In another example, the various steps of the method of manufacture described herein may be manually performed or automated in nature. Further embodiments are contemplated in which the present mold assembly 100 and method are used to provide protruding pads to an item other than a sock 200.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A sock having raised features to be worn by a person on his or her foot, the sock comprising:

a sock body including a sock bottom surface having a sock toe portion and an oppositely disposed sock heel portion; and a plurality of pads affixed to the sock bottom surface at a front area of the sock bottom surface located proximate said sock toe portion, wherein the plurality of pads consists of a three-dimensional, metacarpal paw pad and four three-dimensional, spaced-apart digital paw pads arranged frontward of and spaced-apart from the metacarpal paw pad, the metacarpal paw pad and the four spaced-apart digital paw pads formed separately with respect to one another; wherein the sock bottom surface includes no further pads in addition to said plurality of pads, and said plurality of pads are arranged to cover a front ball of the foot of the person wearing said sock and provide a visual effect and a tactile sensation representative of an actual animal paw to said person.

2. The sock as recited in claim 1, wherein said plurality of pads are securely affixed to said sock bottom surface proximate said sock toe portion with an adhesive.

3. The sock as recited in claim 1, wherein said plurality of pads are formed of a urethane foam material.

4. The sock as recited in claim 1, wherein said plurality of pads are formed of a polyurethane foam material.

5. The sock as recited in claim 1, wherein said plurality of pads further provide an audible effect as said plurality of pads compress and decompress as the person wearing said sock walks.

* * * * *